US007975863B2

(12) United States Patent
Till

(10) Patent No.: US 7,975,863 B2
(45) Date of Patent: Jul. 12, 2011

(54) BEVERAGE BOTTLING PLANT WITH A BEVERAGE BOTTLE CLOSING MACHINE FOR APPLYING A SCREW-TOP BOTTLE CLOSURE TO A BEVERAGE BOTTLE

(75) Inventor: Volker Till, Hofheim/Taunus (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 1028 days.

(21) Appl. No.: 11/436,895

(22) Filed: May 18, 2006

(65) Prior Publication Data

US 2006/0278599 A1 Dec. 14, 2006

(30) Foreign Application Priority Data

May 19, 2005 (DE) ..... 10 2005 022 952

(51) Int. Cl.

| | |
|---|---|
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 51/00*** | (2006.01) |
| ***B65D 49/12*** | (2006.01) |
| ***B65D 45/16*** | (2006.01) |
| ***B65D 83/00*** | (2006.01) |

(52) U.S. Cl. ..... 215/252; 215/253; 215/258; 215/288; 215/388

(58) Field of Classification Search ..... 215/252, 215/258, 388, 288, 253

See application file for complete search history.

(56) References Cited

U.S. PATENT DOCUMENTS

| | | | | |
|---|---|---|---|---|
| 3,874,540 | A | 4/1975 | Hidding et al. | |
| 4,567,991 | A | 2/1986 | Anderson | |
| 4,760,941 | A * | 8/1988 | Salmon et al. | 222/153.07 |
| 4,771,904 | A | 9/1988 | Perne et al. | |
| 5,040,692 | A * | 8/1991 | Julian | 215/252 |
| 5,115,932 | A * | 5/1992 | Schneider | 215/252 |
| 5,285,912 | A * | 2/1994 | Molinaro | 215/256 |
| 5,318,192 | A * | 6/1994 | Rebeyrolle et al. | 215/252 |
| 6,336,566 | B1 * | 1/2002 | Lipson | 215/388 |
| 2002/0148803 | A1 | 10/2002 | Chang | |

FOREIGN PATENT DOCUMENTS

| | | | |
|---|---|---|---|
| DE | 22 23 845 | A | 12/1972 |
| DE | 80 01 216 | | 4/1980 |
| DE | 3038 453 | A1 | 5/1982 |
| DE | 94 10 956 | U1 | 12/1994 |
| DE | 699 16 520 | T2 | 9/1999 |
| EP | 0413 466 | A1 | 2/1991 |
| EP | 0941 938 | A | 9/1999 |
| FR | 2 862 620 | A | 5/2005 |

OTHER PUBLICATIONS

European Patent Office Search Report EP 1 724 201 A3 and English translation thereof.

* cited by examiner

*Primary Examiner* — Anthony Stashick
*Assistant Examiner* — Andrew T Kirsch
(74) *Attorney, Agent, or Firm* — Nils H. Ljungman & Associates

(57) ABSTRACT

Beverage bottling plant with a beverage bottle closing machine for applying a screw-top bottle closure to a beverage bottle. The ring portion of the screw-top bottle closure has engaging surfaces which engage with engaging surfaces of the bottle to essentially prevent or minimize the rotation of the ring portion upon unscrewing of the screw-top bottle closure.

20 Claims, 4 Drawing Sheets

BEVERAGE BOTTLING PLANT WITH A BEVERAGE BOTTLE CLOSING MACHINE FOR APPLYING A SCREW-TOP BOTTLE CLOSURE TO A BEVERAGE BOTTLE

BACKGROUND

1. Technical Field

This application relates to a beverage bottling plant with a beverage bottle closing machine for applying a screw-top bottle closure to a beverage bottle, which screw-top bottle closure is designed to essentially prevent or minimize the tampering thereof. This application further relates to a combination of a tamper-evident closure and a container opening with an opening neck that preferably has a thread and a closure cap that can be screwed onto the tread, which cap has, on its lower end, a tamper-evident ring which is connected with the closure cap by means of a plurality of shear webs that are distributed around its periphery, whereby a plurality of ratchets are located on the cylindrical surface of the tamper-evident ring and are engaged with locking teeth that are molded on the opening neck so that the screwed-on closure cap can be removed only by shearing off the shear webs from the opening neck, 2. Background Information In the sale of beverages such as soft drinks, for example, but also of liquid food products such as milk, for example, a majority of the beverages are sold in bottles. Bottles made of plastic such as PET, HDPE etc. that can be closed with a screw top account for a significant share of the market.

One disadvantage of simple configurations of screw tops is that they can be opened and closed again without this process being detectable by the consumer before the beverage is consumed.

On one hand, bottles that have been opened without the consumer's knowledge can be tampered with, and on the other hand, when the bottle is opened pathogenic microorganisms can get into the beverage or the bottled liquid. Because this opening represents a health hazard, it is desirable to clearly indicate whether or not a screw top has been opened.

For this purpose, numerous configurations of what are termed tamper-evident closures have been presented in the past. A large percentage of these closures consist of screw tops with a safety ring which separates from the threaded portion of the closure when the closure is opened.

The prior art discloses how screw tops with a safety ring and/or a sealing system between the bottle and the cap can be realized so that an axial seal is created directly on the end surface of a ring-shaped edge or the mouth of a bottle.

For this purpose, soft or flexible seal means are introduced in the area in question of the cap of a screw closure and the safety ring is provided with ratchet teeth that are oriented radially or axially. As the cap is screwed onto the bottle, these ratchet teeth slide along locking teeth which are located in the cylindrical surface of the bottle and lock in place, in the manner of a ratchet, in the position they have reached.

The objective of configurations of this type is to keep the angle of rotation by which the screw closure can be opened without the safety ring detaching from the cap as small as possible.

A configuration of this type was presented by DE 699 16 520 T2, for example. This publication of the prior art shows a combination of bottle mouth and screw closure with a safety ring, whereby the locking teeth and ratchets are present in different numbers. This publication also shows a bottle mouth in which the locking teeth are located not over the entire periphery of the bottle mouth but only in two partial segments.

The prior art also teaches a tamper-proof closure of the type described in German Utility Model 80 01 216. On this tamper-proof closure, the ratchet teeth are particularly long, so that they have essentially the form and function of a ratchet pawl.

Practical tests, however, have shown that in the configurations of the prior art of screw tops with a safety ring, it is possible to turn the screw cap by a certain angle of rotation without separating the safety ring from the threaded portion of the closure.

It has also been shown that this angle of rotation can be very large, in particular on bottles that, on account of the process used in their manufacture, do not have a calibrated mouth area, i.e. one that is not manufactured to very close tolerances in terms of shape and dimensions—such as bottles made of HDPE, for example.

In such cases it is even possible to open screw tops far enough for the seal elements of the screw top to break contact with the sealing surfaces provided on the bottle mouth for the purpose, as a result of which any $CO_2$ that is contained in the bottle can escape from it. This disadvantage also creates the conditions for the potential contamination of the liquid inside the bottle.

OBJECT OR OBJECTS

Taking into consideration the information disclosed in the prior art, the object of at least one possible embodiment is to overcome the disadvantages described above and to develop a combination of a tamper-evident closure and a container opening as described herein according to at least one possible embodiment, so that with this combination, as a result of the particular small contact angle that results, without damage to the tamper-evident closure, only such small angles of rotation are possible that the seal and sealing surface of the bottle closure do not lose their sealing action.

SUMMARY

At least one possible embodiment of the invention teaches that this object is accomplished by a combination of a tamper-evident closure and a container opening, wherein on the opening neck there are a number of locking teeth distributed on the periphery, and a number of ratchets distributed on the circumference of the tamper-evident ring, whereby the locking teeth and ratchets that correspond to one another have different stop angles with respect to one another. Further features of at least one possible embodiment are discussed herein.

Consequently, a locking connection with essentially no space in between is formed with a pair of locking teeth and ratchets that correspond directly to one another, which are also provided in different numbers from each other, and ultimately achieve a sealed application of a closing cap with the neck of the associated opening.

On account of the unequal number of locking teeth and ratchets and their particular advantageous arrangement, not all of the circulating teeth are guided into the locking position simultaneously. Instead, they are engaged one after another. In this case there is only a small angular difference between the potential achievement or non-achievement of a final sealing locked position. The result is the achievement of a significantly improved sealing action and precision of a combination seal of this type that gives evidence of potential tampering.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF DRAWINGS

At least one possible embodiment is explained in greater detail below on the basis of the prior art and other exemplary embodiments. In the drawings.

DESCRIPTION OF EMBODIMENT OR EMBODIMENTS

Figure 1A:
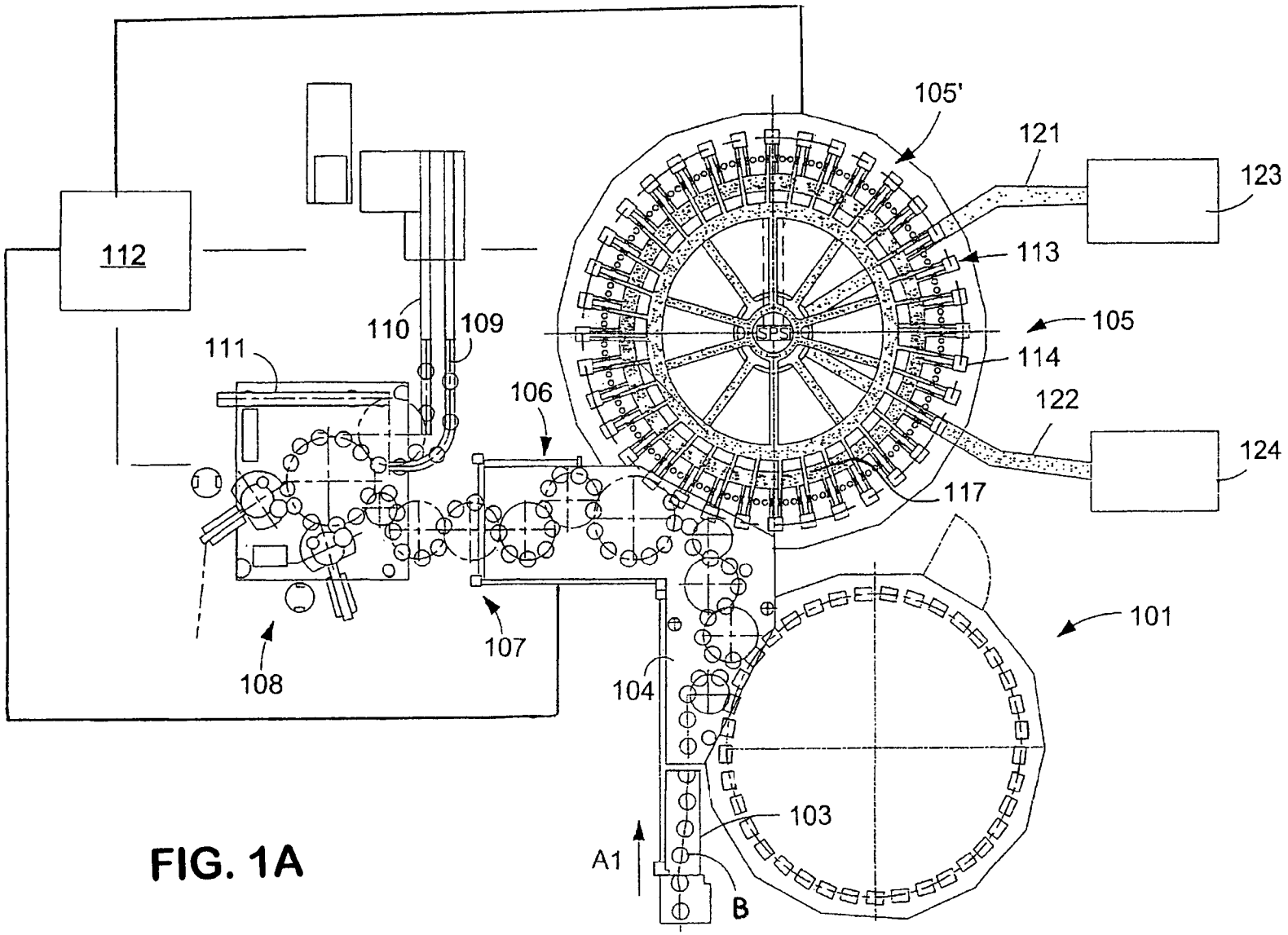
FIG. 1A shows a beverage bottling plant according to at least one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Figure 1:
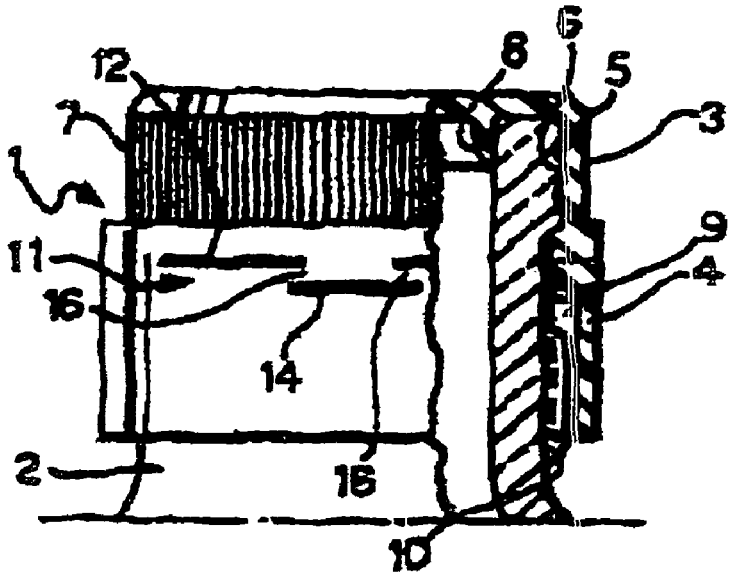
FIG. 1 is a partial view and a partial view in cross section of a closure combination of the prior art in the locked position.
Figure 2:
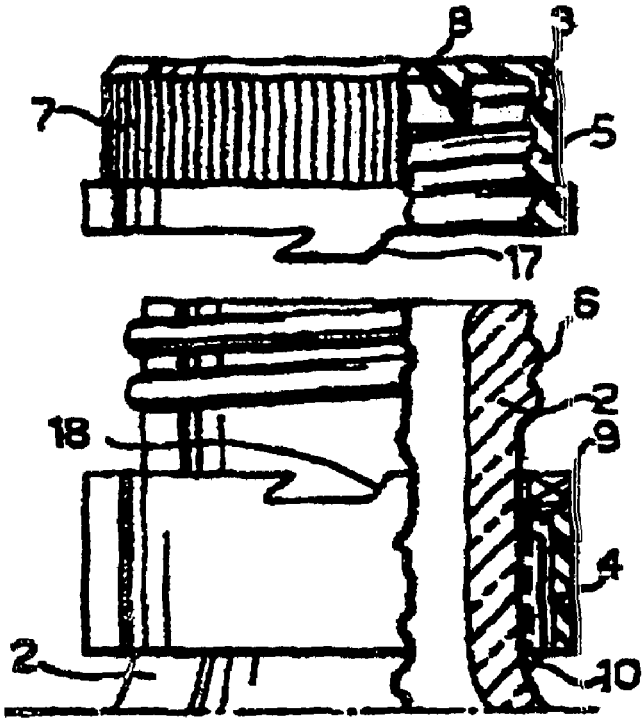
FIG. 2 shows an opened closure with a separated tamper-evident ring.

In FIGS. 1 and 2, the number 1 represents overall a combination of a general tamper-evident closure on a neck 2 of a bottle. Instead of a bottle, a tamper-evident closure can naturally also be provided on different containers, suitable packages or opening necks in this regard, in particular with the configuration taught by at least one possible embodiment and described below. A cap and bottle neck combination is described below in the form of one exemplary embodiment of such closures.

The closure 1 comprises a closure cap 3 and a quality-assurance or tamper-evident ring 4. The closure cap is provided on the inside with a single-flight or multiple thread 5 which is engaged with a male thread 6 that is provided on the neck 2. The area identified as 7 is fluting that is provided on the outside of the closure cap 3. A ring-shaped and thin-walled edge in the interior of the cap 3 is designated 8, and can also be provided in the form of a sealing compound to seal the end surface or can be injected.

The tamper-evident ring 4 is equipped on the inside with a plurality of axial ratchets 9 which can be realized in the form of saw teeth. These teeth are in a functional connection with a corresponding number of locking teeth 10, which can also be realized in the form of saw teeth and are attached to the neck 2 of the bottle. The locking teeth and ratchets 9, 10 are oriented so that they engage with one another during the application and tightening of a closure 1 on the neck of the bottle.

The cap 3 and the tamper-evident ring 4 are permanently connected with each other by means of an encircling zone of weakened material 11. For that purpose, they are designed so that they rip apart along this weakened zone the first time the closure is opened. The zone 11 comprises notches or recesses 12, 14 that are located all around the periphery, and lie on peripheral lines 13, 15 that are located at a slight distance 16 from each other. Instead of such notches or recesses 13, 14, separation webs (not shown), such as small plastic connecting pieces or strips, can also be provided.

The closure 1 is applied to the neck 2 of the bottle by screwing the thread 5 onto the thread 6. During the screwing process, the cap 3, during its rotation, drives the tamper-evident ring 4 along with it, so that during the screwing process the locking and locking teeth 9, 10 become engaged with each other.

Figure 3:
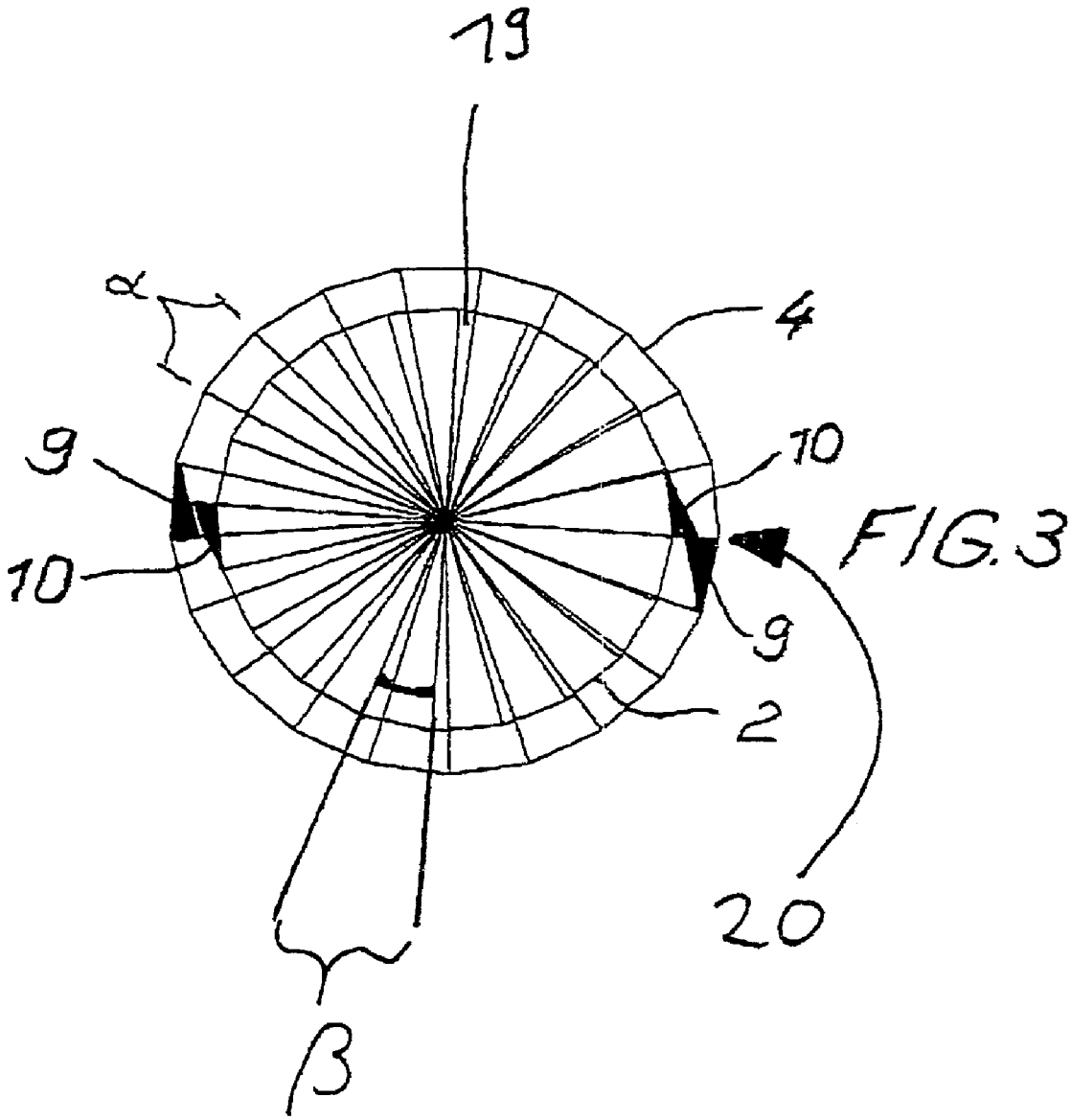
FIG. 3 shows an example of an arrangement of locking elements according to at least one possible embodiment.

In contrast to this realization of the locking elements, which is in itself part of the prior art, FIG. 3 presents a drawing of one exemplary embodiment of an arrangement according to at least one possible embodiment of the individual locking elements and their effect on one another.

As shown in the drawing, on the periphery of the bottle neck 2 there are a plurality of locking teeth 10 that are at a uniform angular interval $\alpha$ from one another, and that are associated with a reduced number of ratchets 9 on the interior cylindrical surface of the tamper-evident ring 4. These ratchets are at the same angular interval $\beta$ from one another.

As shown in FIG. 3, the stop angle or contact angle 19 of the associated locking teeth and ratchets 9, 10 varies continuously. Consequently, when the closing cap 1 is in the final sealing application, at least one pair of these locking elements 9, 10, forms a locking connection with no separation or with almost no separation on the end-surface edge of the opening neck 2 of a bottle, as a result of which only a small angle of rotation, at which the sealing function of the screw top is reliably maintained, becomes possible without damage to the original closure.

In the illustrated exemplary embodiment, on the neck 2 there are twenty locking teeth 10 and twenty-one ratchets 9 in the tamper-evident ring 4. On account of the different number and their arrangement, not all of the locking teeth and ratchets 10, 9 are guided uniformly into the locking position, but they lock individually, one after another, whereby on account of the number of teeth selected, there is only a small difference between the potential arrival or non-arrival in a final locked position.

With the selected number of teeth, this difference is 0.86° on account of the angle of rotation of a 1/20 pitch or 18° and a 1/21 pitch at 17.14°. Given the resulting difference of 0.86°, the axial height difference that results during the opening of the closure is only 0.12 mm, which leads to a significantly enhanced sealing action and system precision. When the closure 1 is rotated in the opening direction, the tamper-evident ring 4 is consequently immediately separated from the cap 3 in the web area 17, 18. Any undetected tampering with the contents is therefore impossible.

Figure 4:
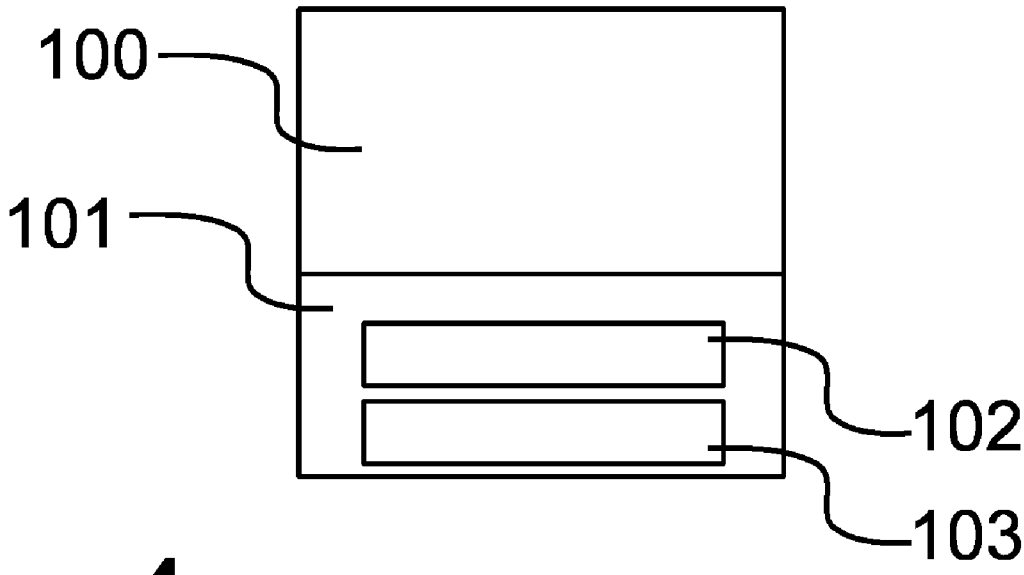
FIG. 4 shows a block diagram of another example of an arrangement of locking elements according to at least one possible embodiment.

The locking teeth and ratchets 9, 10 are advantageously located on the respective outside and inside cylindrical surfaces. It is also conceivable that these teeth can be located on the end surface. A combination with the location on a neck collar of the opening neck is also possible. The configuration of the locking teeth and ratchets 9, 10 can be provided in the form of depressions or elevations. Depending on the individual requirements, locking elements of this type can also be provided on different levels or on multiple levels, whereby an arrangement in two levels with angular areas that are offset with respect to one another is also conceivable. A block diagram of an embodiment of a cap with a cap portion 100 and a ring portion 101 having two levels of locking elements or projections 102, 103 is shown in FIG. 4.

Finally, such interacting locking elements can run along a diagonal line, whereby such a line can correspond, for example, to the pitch of the thread on the container or opening neck 2.

Likewise, the locking teeth 10 can also be located so that the teeth are not always at the same angular interval $\beta$ from one another. Rather, these teeth can also be located at different angular intervals from one another, as a result of which, in connection with the ratchets 9, a further reduction in the residual stop angle can be achieved.

To achieve a particularly small residual stop angle, different angular intervals can be provided, additionally or also exclusively among the ratchets 9.

Locking teeth and ratchets 10, 9 can also be provided in the same number, whereby in such a case, a particularly small residual stop angle can be achieved if the locking teeth and/or ratchets 10, 19 each are at different angular intervals. It should also be understood that other possible embodiments and configurations of the locking teeth and ratchets are within the scope of this application. Specifically, the number of locking teeth or ratchets, as well as the intervals between adjacent locking teeth or adjacent ratchets, can be varied as desired to be greater or lesser than the exemplary embodiments described herein.

One feature or aspect of an embodiment is believed at the time of the filing of this patent application to possibly reside broadly in a combination of a tamper-evident closure and a container opening with an opening neck that preferably has a thread and a closure cap that can be screwed onto the tread, which cap has, on its lower end, a tamper-evident ring which is connected with the closure cap by means of a plurality of shear webs that are distributed around its periphery, whereby a plurality of ratchets are located on the cylindrical surface of the tamper-evident ring and are engaged with locking teeth that are molded on the opening neck so that the screwed-on closure cap can be removed only by shearing off the shear webs from the opening neck, characterized in that on the opening neck there are a number of locking teeth 10 distributed on the periphery, and a number of ratchets 9 distributed on the circumference of the tamper-evident ring, whereby the locking teeth and ratchets 10, 9 that correspond to one another have different stop angles 19 with respect to one another.

Another feature or aspect of an embodiment is believed at the time of the filing of this patent application to possibly reside broadly in the closure, wherein the locking teeth and ratchets are present in different numbers and that during the sealing screwing process, they form a continuously smaller stop angle 19.

Another feature or aspect of an embodiment is believed at the time of the filing of this patent application to possibly reside broadly in the closure, characterized in that the locking and ratchet teeth 10, 9 are distributed on the periphery in different numbers or in the same number at equal pitches or intervals and form different stop angles 19 with respect to one another.

Yet another feature or aspect of an embodiment is believed at the time of the filing of this patent application to possibly reside broadly in the closure, characterized in that the locking and ratchet teeth 10, 9 are distributed on the periphery in different numbers or in the same number not at equal pitches or intervals and form different stop angles 19 with respect to one another.

Still another feature or aspect of an embodiment is believed at the time of the filing of this patent application to possibly reside broadly in the closure, characterized in that the locking teeth and ratchets 10, 9 are present in different numbers and that during the sealing screwing process, they form a continuously smaller stop angle 19.

A further feature or aspect of an embodiment is believed at the time of the filing of this patent application to possibly reside broadly in the closure, characterized in that during the sealing application, at least one pair 20 of the respective interacting locking teeth and ratchets 10, 9 form a locking connection, the stop angle 19 of which is equal to or almost equal to zero degrees.

Another feature or aspect of an embodiment is believed at the time of the filing of this patent application to possibly reside broadly in the closure, characterized in that on the opening neck cylindrical surface 2 there are at least n locking teeth 10 and on the cylindrical surface of the tamper-evident ring 4 there are at least n−1 ratchet teeth 9.

Yet another feature or aspect of an embodiment is believed at the time of the filing of this patent application to possibly reside broadly in the closure, characterized in that on the opening neck cylindrical surface 2 there are at least n locking teeth 10 and on the cylindrical surface of the tamper-evident ring there are at least n+1 ratchet teeth 9.

Still another feature or aspect of an embodiment is believed at the time of the filing of this patent application to possibly reside broadly in the closure, characterized in that on the opening neck cylindrical surface 2 there are at least twenty locking teeth 10 and on the cylindrical surface of the tamper-evident ring 45 there are at least twenty-one ratchet teeth 9.

A further feature or aspect of an embodiment is believed at the time of the filing of this patent application to possibly reside broadly in the closure, characterized in that the locking teeth and ratchets 10, 9 are located on the respective cylindrical surfaces.

Another feature or aspect of an embodiment is believed at the time of the filing of this patent application to possibly reside broadly in the closure, characterized in that the locking teeth and ratchets 10, 9 are located on the respective end surfaces.

Yet another feature or aspect of an embodiment is believed at the time of the filing of this patent application to possibly reside broadly in the closure, characterized in that the locking teeth and ratchets 10, 9 are realized in the form of end-side arrangements of the tamper-evident ring 4 and of a neck collar of the opening neck.

Still another feature or aspect of an embodiment is believed at the time of the filing of this patent application to possibly reside broadly in the closure, characterized in that the locking teeth 10 are realized in the form of depressions and the ratchets 9 are realized in the form of elevations, or vice-versa.

A further feature or aspect of an embodiment is believed at the time of the filing of this patent application to possibly reside broadly in the closure, characterized in that there are at least two levels of locking elements.

Another feature or aspect of an embodiment is believed at the time of the filing of this patent application to possibly reside broadly in the closure, characterized in that the locking elements in two levels are offset with respect to one another by an angle.

Yet another feature or aspect of an embodiment is believed at the time of the filing of this patent application to possibly reside broadly in the closure, characterized in that the locking elements are realized in the form of part of an HDPE container.

Still another feature or aspect of an embodiment is believed at the time of the filing of this patent application to possibly reside broadly in a beverage bottling plant for filling beverage bottles with liquid beverage material, said beverage bottling plant comprising: a filling machine being configured and disposed to fill empty bottles with a filling material; a first moving arrangement being configured and disposed to move bottles to said filling machine; said filling machine comprising: a moving device being configured and disposed to accept bottles from said first moving arrangement and to move bottles within said filling machine; an apparatus being configured and disposed to hold bottles during filling; and at least one filling device being configured and disposed to fill bottles with a filling material upon the bottles being within said filling machine; a closing machine being configured and disposed to close filled bottles; a second moving arrangement being configured and disposed to accept filled bottles from said moving device of said filling machine to move filled bottles out of said filling machine; said second moving arrangement being configured and disposed to move filled bottles from said filling machine to said closing machine; said closing machine comprising: a moving device being configured and disposed to accept filled bottles from said second moving arrangement and to move filled bottles within said closing machine; an apparatus being configured and disposed to hold filled bottles during closing; a supply of screw-top closures, said screw-top closures each comprising: an upper cap portion and a lower ring portion; said cap portion comprising an internal threading to permit said screw-top closures to be screwed onto a threaded mouth portion of filled bottles to close filled bottles; said ring portion being detachably connected to said cap portion by a plurality of shear webs to permit removal of said cap portion from its corresponding bottle and to provide indication that said cap portion has been at least partially displaced from a sealing engagement with the lip of the mouth opening of its corresponding bottle; said ring portion comprising a plurality of ratchet-like projections disposed to project inwardly from the inner cylindrical surface of the ring portion; said projections being configured to engage with locking teeth molded on a neck portion of bottles to be closed upon installation of said screw-top closures on the bottles to minimize and restrict rotational movement of said ring portion upon an unscrewing movement of said cap portion connected thereto, and to thus minimize and restrict rotational movement of said cap portion without detachment of said cap portion from said ring portion to minimize unintentional displacement of said cap portion from a sealing engagement with the lip of the mouth opening of its corresponding bottle and to provide indication of displacement of said cap portion from a sealing engagement with the lip of the mouth opening of its corresponding bottle; each of said projections comprising a stop surface; and said stop surface of each of said projections being disposed, upon screwing on of said screw-top closure on a bottle, adjacent and to face a stop surface of a corresponding locking tooth of the bottle, wherein the distance between each pair of adjacent stop surfaces is different for each pair of adjacent stop surfaces, and wherein the distance between at least one pair of adjacent stop surfaces is minimized to minimize and restrict rotational movement of said ring portion upon an unscrewing movement of said cap portion connected thereto; at least one closing device being configured and disposed to receive screw-top closures from said supply of screw-top closures; and said at least one closing device being configured and disposed to close filled bottles by screwing said screw-top closures onto the mouth portions of filled bottles upon the filled bottles being within said closing machine.

A further feature or aspect of an embodiment is believed at the time of the filing of this patent application to possibly reside broadly in a method of operating the beverage bottling plant, said method comprising the steps of: moving empty bottles into said filling machine; filling empty bottles in said filling machine with a filling material; moving filled bottles out of said filling machine and into said closing machine; supplying said screw-top closures to said at least one closing device; screwing said screw-top closures on mouth portions of corresponding bottles to be closed; and stopping screwing on said screw-top closures upon said cap portions being in a sealing engagement with the lip of the mouth openings of the corresponding bottles, and upon said projections being engaged with locking teeth molded on a neck portion of the corresponding bottles.

Another feature or aspect of an embodiment is believed at the time of the filing of this patent application to possibly reside broadly in a combination of a screw-top closure and a bottle, wherein: said screw-top closure comprising an upper cap portion and a lower ring portion; said cap portion comprising an internal threading; said bottle comprising a mouth portion; said mouth portion comprising an external threading being configured and disposed to engage with said internal threading of said cap portion to permit said screw-top closure to be screwed onto said mouth portion to seal and close said bottle; said ring portion being detachably connected to said cap portion by a plurality of shear webs to permit removal of said cap portion from said bottle and to provide indication that said cap portion has been at least partially displaced from a sealing engagement with said bottle mouth portion; said ring portion comprising a plurality of ratchet-like projections disposed to project inwardly from the inner cylindrical surface of the ring portion; said bottle comprising a neck portion adjacent said mouth portion; said neck portion comprising projecting locking teeth; said projections of said ring portion being configured and disposed to engage with said locking teeth of said neck portion upon installation of said screw-top closures on the bottles to minimize and restrict rotational movement of said ring portion upon an unscrewing movement of said cap portion connected thereto, and to thus minimize and restrict rotational movement of said cap portion without detachment of said cap portion from said ring portion to minimize unintentional displacement of said cap portion from a sealing engagement with said bottle mouth portion and to provide indication of displacement of said cap portion from said sealing engagement; each of said projections comprising a stop surface; each of said locking teeth comprising a stop surface; and said stop surface of each of said projections being disposed, upon screwing on of said screw-top closure on a bottle, adjacent and to face a stop surface of a corresponding locking tooth of said bottle, wherein the distance between each pair of adjacent stop surfaces is different for each pair of adjacent stop surfaces, and wherein the distance between at least one pair of adjacent stop surfaces is minimized to minimize and restrict rotational movement of said ring portion upon an unscrewing movement of said cap portion connected thereto.

Yet another feature or aspect of an embodiment is believed at the time of the filing of this patent application to possibly reside broadly in the combination, wherein said locking teeth and said projections are present in different numbers and that upon the screwing on of said screw-top closure, adjacent pairs of locking teeth and projections form a continuously smaller distance between the adjacent stop surfaces of each pair.

Still another feature or aspect of an embodiment is believed at the time of the filing of this patent application to possibly reside broadly in a method of closing and opening the combination of a screw-top closure and a bottle, said method comprising the steps of: screwing said screw-top closure onto said mouth portion of said bottle to seal and close said bottle; rotating said screw-top closure by unscrewing said cap portion; contacting at least one pair of adjacent stop surfaces to minimize and restrict rotational movement of said ring portion; continuing unscrewing said cap portion upon the rotational movement of said ring portion being minimized and restricted, and consequently detaching said cap portion from said ring portion; and removing said cap portion from said mouth portion of said bottle to permit access to the contents therein.

A further feature or aspect of an embodiment is believed at the time of the filing of this patent application to possibly reside broadly in the method, wherein said locking teeth and said projections are present in different numbers and that during the sealing screwing process, adjacent pairs of locking teeth and projections form a continuously smaller distance between the adjacent stop surfaces of each pair.

At least one possible embodiment of the invention relates to a combination of a tamper-evident closure and a container opening with an opening neck that preferably has a thread and a closure cap that can be screwed onto the tread, which cap has, on its lower end, a tamper-evident ring which is connected with the closure cap by means of a plurality of shear webs that are distributed around its periphery, whereby a plurality of ratchets are located on the cylindrical surface of the tamper-evident ring and are engaged with locking teeth that are molded on the opening neck so that the screwed-on closure cap can be removed only by shearing off the shear webs from the opening neck, whereby the invention teaches that on the opening neck there are a number of locking teeth 10 at least one possible embodiment distributed on the periphery, and a number of ratchets 9 at least one possible embodiment distributed on the circumference of the tamper-evident ring, whereby the locking teeth and ratchets 10, 9 at least one possible embodiment that correspond to one another have different stop angles 19 with respect to one another.

The components disclosed in the various publications, disclosed or incorporated by reference herein, may possibly be used in possible embodiments of the present invention, as well as equivalents thereof.

Some examples of bottling and container handling systems and components thereof which may possibly be utilized or adapted for use in at least one possible embodiment, may possibly be found in the following U.S. patent application. Ser. No. 10/653,617, filed on Sep. 2, 2003, entitled "Labeling Machine with a Sleeve Mechanism for Preparing and Applying Cylindrical Labels onto Beverage Bottles and Other Beverage Containers in a Beverage Container Filling Plant;" Ser. No. 10/666,931, filed on Sep. 18, 2003, entitled "Beverage Bottling Plant for Filling Bottles with a Liquid Beverage Filling Material and a Labelling Station for Filled Bottles and Other Containers;" Ser. No. 10/723,451, filed on Nov. 26, 2003, entitled "Beverage Bottling Plant for Filling Beverage Bottles or Other Beverage Containers with a Liquid Beverage Filling Material and Arrangement for Dividing and Separating of a Stream of Beverage Bottles or Other Beverage Containers;" Ser. No. 10/739,895, filed on Dec. 18, 2003, entitled "Method of Operating a Beverage Container Filling Plant with a Labeling Machine for Labeling Beverage Containers Such as Bottles and Cans, and a Beverage Container Filling Plant with a Labeling Machine for Labeling Beverage Containers Such as Bottles and Cans;" Ser. No. 10/756,171, filed on Jan. 13, 2004, entitled "A Beverage Bottling Plant for Filling Bottles and like Containers with a Liquid Beverage Filling Material and a Conveyer Arrangement for Aligning and Distributing Packages Containing Filled Bottles and like Containers;" Ser. No. 10/780,280, entitled "A Beverage Bottling Plant for Filling Bottles with a Liquid Beverage Filling Material, a Container Filling Plant Container Information Adding Station, Such As, a Labeling Station, Configured to Add Information to Containers, Such As, Bottles and Cans, and Modules for Labeling Stations;" Ser. No. 10/786,256, entitled "A Beverage Bottling Plant for Filling Bottles with a Liquid Beverage Filling Material, and a Container Filling Lifting Device for Pressing Containers to Container Filling Machines;" Ser. No. 10/793,659, entitled "A Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" Ser. No. 10/801,924, filed on Mar. 16, 2004, entitled "Beverage Bottling Plant for Filling Bottles with a Liquid Beverage Filling Material, and a Cleaning Device for Cleaning Bottles in a Beverage Bottling Plant;" Ser. No. 10/813,651, filed on Mar. 30, 2004, entitled "A Beverage Bottling Plant for Filling Bottles with a Liquid Beverage Filling Material, and an Easily Cleaned Lifting Device in a Beverage Bottling Plant;" Ser. No. 10/814,624, filed on Mar. 31, 2004, entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" Ser. No. 10/816,787, filed on Apr. 2, 2004, entitled "A Beverage Bottling Plant for Filling Bottles with a Liquid Beverage Filling Material, and Apparatus for Attaching Carrying Grips to Containers with Filled Bottles;" Ser. No. 10/865,240, filed on Jun. 10, 2004, Entitled "A Beverage Bottling Plant for Filling Bottles with a Liquid Beverage Filling Material, a Beverage Container Filling Machine, and a Beverage Container Closing Machine;" Ser. No. 10/883,591, filed on Jul. 1, 2004, entitled "A Beverage Bottling Plant for Filling Bottles with a Liquid Beverage Filling Material Having a Container Filling Plant Container Information Adding Station, Such As, a Labeling Station, Configured to Add Information to Containers, Such As, Bottles and Cans, and Modules for Labeling Stations and a Bottling Plant Having a Mobile Module Carrier;" Ser. No. 10/930,678, filed on Aug. 31, 2004, entitled "A Beverage Bottling Plant for Filling Bottles with a Liquid Beverage Filling Material, a Container Filling Plant Container Filling Machine, and a Filter Apparatus for Filtering a Liquid Beverage;" Ser. No. 10/931,817, filed on Sep. 1, 2004, entitled "A Beverage Bottling Plant for Filling Bottles with a Liquid Beverage Filling Material, Having an Apparatus for Exchanging Operating Units Disposed at Rotating Container Handling Machines;" Ser. No. 10/939,170, filed on Sep. 10, 2004; Ser. No. 10/954,012, filed on Sep. 29, 2004; Ser. No. 10/952,706; Ser. No. 10/962,183, filed on Oct. 8, 2004; Ser. No. 10/967,016, filed on Oct. 15, 2004; Ser. No. 10/982,706, filed on Nov. 5, 2004; Ser. No. 10/982,694; Ser. No. 10/982,710; Ser. No. 10/984,677, filed on Nov. 9, 2004; Ser. No. 10/985,640, filed on Nov. 10, 2004; Ser. No. 11/004,663, filed on Dec. 3, 2004; Ser. No. 11/009,551, filed on Dec. 10, 2004; Ser. No. 11/012,859, filed on Dec. 15, 2004; Ser. No. 11/014,673, filed on Dec. 16, 2004; Ser. No. 11/016,364, filed on Dec. 17, 2004; and Ser. No. 11/016,363.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of bottling and container handling systems and components thereof which may possibly be utilized or adapted for use in at least one possible embodiment, may possibly be found in the following U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No.

6,484,762, entitled "A Filling System with Post-dripping Prevention;" and U.S. Pat. No. 6,668,877, entitled "Filling System for Still Beverages."

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the German Office Action dated Nov. 21, 2005, and/or cited elsewhere are hereby incorporated by reference as if set forth in their entirety herein as follows: DE 30 38 453 A1; DE 22 23 845 A; DE 94 10 956 U1; EP 0413 466 A1; US 2002/0148803 A1; and U.S. Pat. No. 4,567,991.

The corresponding foreign and international patent publication applications, namely, Federal Republic of Germany Patent Application No. 10 2005 022 952.2, filed on May 19, 2005, having inventor Volker Till, and DE-OS 10 2005 022 952.2 and DE-PS 10 2005 022 952.2, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

Some examples of methods and apparatuses for closing bottles and containers and their components that may possibly be utilized or possibly adapted for use in at least one possible embodiment of the present may possibly be found in the following U.S. Pat. No. 5,398,485 issued to Osifchin on Mar. 21, 1995; U.S. Pat. No. 5,402,623 issued to Ahlers on. Apr. 4, 1995; U.S. Pat. No. 5,419,094 issued to Vander Bush, Jr. et al. on May 30, 1995; U.S. Pat. No. 5,425,402 issued to Pringle on Jun. 20, 1995; U.S. Pat. No. 5,447,246 issued to Finke on Sep. 5, 1995; and U.S. Pat. No. 5,449,080 issued to Finke on Sep. 12, 1995.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A combination of a screw-top container and a screw-top closure being completely screwed onto said container in a final, sealed position on said container, wherein:

said screw-top closure comprising a cap portion and a closed ring portion;

said cap portion comprising an internal threading;

said container comprising a mouth portion;

said mouth portion comprising an external threading being configured and disposed to engage with said internal threading of said cap portion to permit said screw-top closure to be screwed onto said mouth portion to seal and close said container;

said container comprising a neck portion adjacent said mouth portion;

said closed ring portion being disposed to completely encircle said neck portion of said container;

said closed ring portion being detachably connected to said cap portion by a plurality of breakable connecting structures to permit detachment of said closed ring portion from said cap portion;

said closed ring portion comprising a plurality of engaging surfaces disposed on the inner cylindrical surface of said closed ring portion;

said neck portion comprising a plurality of engaging surfaces being configured to be engaged by said engaging surfaces of said closed ring portion to minimize rotational movement of said closed ring portion upon an unscrewing movement of said screw-top closure;

each of said engaging surfaces of said closed ring portion being disposed adjacent and to face an engaging surface of said neck portion;

said engaging surfaces of said closed ring portion and said engaging surfaces of said neck portion being configured and disposed to minimize the angular distance between at least one pair of adjacent, facing engaging surfaces, to thereby minimize rotational movement of said closed ring portion upon an unscrewing movement of said screw-top closure, and to thereby cause engagement of said at least one pair of adjacent, facing engaging surfaces and immediately subsequent, substantially simultaneous breakage of all of said plurality of breakable connecting structures prior to opening of the seal between said screw-top closure and said mouth portion of said container upon an unscrewing movement of said screw-top closure.

2. The combination according to claim 1, wherein the maximum angular distance between the closest pair of adjacent, facing engaging surfaces is about one degree.

3. The combination according to claim 2, wherein the maximum angular distance between the closest pair of adjacent, facing engaging surfaces is 0.86 degree.

4. The combination according to claim 3, wherein:

said engaging surfaces of said neck portion comprise at least twenty engaging surfaces;

said engaging surfaces of said closed ring portion comprise at least twenty-one engaging surfaces;

the angular distance between the closest pair of adjacent, facing engaging surfaces is approximately zero degrees or equal to zero degrees;

the angular distance between successive pairs of facing engaging surfaces decreases continuously for at least three successive pairs of facing engaging surfaces, starting with a first pair having a first angular distance therebetween, then to a second pair having a second angular distance therebetween smaller than said first angular distance, and ending with a third pair having a third angular distance therebetween smaller than said second angular distance; and only one of (A), (B), (C):

(A) said closed ring portion of said screw-top closure comprises a ring of at least twenty-one projections;

said at least twenty-one engaging surfaces of said closed ring portion are disposed on said at least twenty-one projections, one engaging surface per projection;

said neck portion of said container comprises a ring of at least twenty depressions in the outer surface of said neck portion; and said at least twenty engaging surfaces of said neck portion are disposed on said at least twenty depressions, one engaging surface per depression;

(B) said closed ring portion of said screw-top closure comprises a ring of at least twenty-one projections;

said at least twenty-one engaging surfaces of said closed ring portion are disposed on said at least twenty-one projections, one engaging surface per projection;

said neck portion of said container comprises a ring of at least twenty projections on the outer surface of said neck portion; and said at least twenty engaging surfaces of said neck portion are disposed on said at least twenty projections, one engaging surface per projection; and (C) said closed ring portion of said screw-top closure comprises a ring of at least twenty-one depressions;

said at least twenty-one engaging surfaces of said closed ring portion are disposed on said at least twenty-one depressions, one engaging surface per depression;

said neck portion of said container comprises a ring of at least twenty projections in the outer surface of said neck portion; and said at least twenty engaging surfaces of said neck portion are disposed on said at least twenty projections, one engaging surface per projection;

and further wherein:

said closed ring portion of said screw-top closure comprises a second ring of engaging surfaces, wherein said second ring of engaging surfaces is disposed closer to said cap portion of said screw-top closure than said ring of at least twenty-one engaging surfaces;

said engaging surfaces of said ring of at least twenty-one engaging surfaces are offset by an angle with respect to said second ring of engaging surfaces; and said container comprises high density polyethylene.

5. The combination according to claim 1, wherein:

said engaging surfaces of said neck portion comprise an even number of engaging surfaces;

said engaging surfaces of said closed ring portion comprise an odd number of engaging surfaces; and the number of said engaging surfaces of said ring portion are either only one more or only one less than the number of said engaging surfaces of said neck portion.

6. The combination according to claim 5, wherein:

said engaging surfaces of said neck portion comprise only twenty engaging surfaces;

said engaging surfaces of said closed ring portion comprise only twenty-one engaging surfaces; and the maximum angular distance between the closest pair of adjacent, facing engaging surfaces is 0.86 degree.

7. The combination according to claim 6, wherein:

said closed ring portion of said screw-top closure comprises twenty-one projections disposed to project inwardly from the inner cylindrical surface of said closed ring portion;

said at least twenty-one engaging surfaces of said closed ring portion are disposed on said at least twenty-one projections, one engaging surface per projection;

said neck portion of said container comprises a ring of at least twenty projections disposed to project outwardly from the outer surface of said neck portion; and said at least twenty engaging surfaces of said neck portion are disposed on said at least twenty projections, one engaging surface per projection.

8. A combination of a screw-top container and a screw-top closure being completely screwed onto said container in a final, sealed position on said container, wherein:

said screw-top closure comprising a cap portion and a ring portion;

said cap portion comprising an internal threading;

said container comprising a mouth portion;

said mouth portion comprising an external threading being configured and disposed to engage with said internal threading of said cap portion to permit said screw-top closure to be screwed onto said mouth portion to seal and close said container;

said ring portion being detachably connected to said cap portion by at least one breakable connecting structure to permit detachment of said ring portion from said cap portion;

said ring portion comprising a plurality of engaging surfaces;

said container comprising a neck portion adjacent said mouth portion;

said neck portion comprising a plurality of engaging surfaces being configured to be engaged by said engaging surfaces of said ring portion to minimize rotational movement of said ring portion upon an unscrewing movement of said screw-top closure;

each of said engaging surfaces of said ring portion being disposed adjacent and to face an engaging surface of said neck portion;

said engaging surfaces of said ring portion and said engaging surfaces of said neck portion being configured and disposed to minimize the angular distance between at least one pair of adjacent, facing engaging surfaces, to thereby minimize rotational movement of said ring portion upon an unscrewing movement of said screw-top closure, and to thereby cause engagement of said at least one pair of adjacent, facing engaging surfaces and immediately subsequent, substantially simultaneous breakage of all of said at least one breakable connecting structure prior to opening of the seal between said screw-top closure and said mouth portion of said container upon an unscrewing movement of said screw-top closure.

9. The combination according to claim 8, wherein the maximum angular distance between the closest pair of adjacent, facing engaging surfaces is about one degree.

10. The combination according to claim 9, wherein the maximum angular distance between the closest pair of adjacent, facing engaging surfaces is 0.86 degree.

11. The combination according to claim 10, wherein:

said engaging surfaces of said neck portion comprise at least twenty engaging surfaces; and said engaging surfaces of said ring portion comprise at least twenty-one engaging surfaces.

12. The combination according to claim 11, wherein:

the angular distance between the closest pair of adjacent, facing engaging surfaces is approximately zero degrees or equal to zero degrees;

the angular distance between successive pairs of facing engaging surfaces decreases continuously for at least three successive pairs of facing engaging surfaces, starting with a first pair having a first angular distance therebetween, then to a second pair having a second angular distance therebetween smaller than said first angular distance, and ending with a third pair having a third angular distance therebetween smaller than said second angular distance;

said ring portion of said screw-top closure comprises a ring of at least twenty-one projections;

said at least twenty-one engaging surfaces of said ring portion are disposed on said at least twenty-one projections, one engaging surface per projection;

said neck portion of said container comprises a ring of at least twenty depressions in the outer surface of said neck portion; and said at least twenty engaging surfaces of said neck portion are disposed on said at least twenty depressions, one engaging surface per depression.

13. The combination according to claim 12, wherein:

said ring portion of said screw-top closure comprises a second ring of engaging surfaces, wherein said second ring of engaging surfaces is disposed closer to said cap portion of said screw-top closure than said ring of at least twenty-one engaging surfaces;

said engaging surfaces of said ring of at least twenty-one engaging surfaces are offset by an angle with respect to said second ring of engaging surfaces; and said container comprises high density polyethylene.

14. The combination according to claim 11, wherein:

the angular distance between the closest pair of adjacent, facing engaging surfaces is approximately zero degrees or equal to zero degrees;

the angular distance between successive pairs of facing engaging surfaces decreases continuously for at least three successive pairs of facing engaging surfaces, starting with a first pair having a first angular distance therebetween, then to a second pair having a second angular distance therebetween smaller than said first angular distance, and ending with a third pair having a third angular distance therebetween smaller than said second angular distance;

said ring portion of said screw-top closure comprises a ring of at least twenty-one projections;

said at least twenty-one engaging surfaces of said ring portion are disposed on said at least twenty-one projections, one engaging surface per projection;

said neck portion of said container comprises a ring of at least twenty projections on the outer surface of said neck portion; and said at least twenty engaging surfaces of said neck portion are disposed on said at least twenty projections, one engaging surface per projection.

15. The combination according to claim 14, wherein:

said ring portion of said screw-top closure comprises a second ring of engaging surfaces, wherein said second ring of engaging surfaces is disposed closer to said cap portion of said screw-top closure than said ring of at least twenty-one engaging surfaces;

said engaging surfaces of said ring of at least twenty-one engaging surfaces are offset by an angle with respect to said second ring of engaging surfaces; and said container comprises high density polyethylene.

16. The combination according to claim 11, wherein:

the angular distance between the closest pair of adjacent, facing engaging surfaces is approximately zero degrees or equal to zero degrees;

the angular distance between successive pairs of facing engaging surfaces decreases continuously for at least three successive pairs of facing engaging surfaces, starting with a first pair having a first angular distance therebetween, then to a second pair having a second angular distance therebetween smaller than said first angular distance, and ending with a third pair having a third angular distance therebetween smaller than said second angular distance;

said ring portion of said screw-top closure comprises a ring of at least twenty-one depressions;

said at least twenty-one engaging surfaces of said ring portion are disposed on said at least twenty-one depressions, one engaging surface per depression;

said neck portion of said container comprises a ring of at least twenty projections in the outer surface of said neck portion; and said at least twenty engaging surfaces of said neck portion are disposed on said at least twenty projections, one engaging surface per projection.

17. The combination according to claim 16, wherein:

said ring portion of said screw-top closure comprises a second ring of engaging surfaces, wherein said second ring of engaging surfaces is disposed closer to said cap portion of said screw-top closure than said ring of at least twenty-one engaging surfaces;

said engaging surfaces of said ring of at least twenty-one engaging surfaces are offset by an angle with respect to said second ring of engaging surfaces; and said container comprises high density polyethylene.

18. The combination according to claim 8, wherein:

said engaging surfaces of said neck portion comprise an even number of engaging surfaces; and said engaging surfaces of said ring portion comprise an odd number of engaging surfaces.

19. The combination according to claim 18, wherein:

said engaging surfaces of said neck portion comprise only twenty engaging surfaces;

said engaging surfaces of said ring portion comprise only twenty-one engaging surfaces; and the maximum angular distance between the closest pair of adjacent, facing engaging surfaces is 0.86 degree.

20. The combination according to claim 19, wherein:

said ring portion of said screw-top closure comprises twenty-one projections disposed to project inwardly from the inner cylindrical surface of said ring portion;

said at least twenty-one engaging surfaces of said ring portion are disposed on said at least twenty-one projections, one engaging surface per projection;

said neck portion of said container comprises a ring of at least twenty projections disposed to project outwardly from the outer surface of said neck portion; and said at least twenty engaging surfaces of said neck portion are disposed on said at least twenty projections, one engaging surface per projection.

* * * * *